US007502580B2

(12) United States Patent
Hays

(10) Patent No.: US 7,502,580 B2
(45) Date of Patent: Mar. 10, 2009

(54) TWO COMPONENT DEVELOPMENT SYSTEM USING ION OR ELECTRON CHARGED TONER

(75) Inventor: Dan A. Hays, Fairport, NY (US)

(73) Assignee: Xerox Corporation, Norfolk, CT (US)

( * ) Notice: Subject to any disclaimer, the term of this patent is extended or adjusted under 35 U.S.C. 154(b) by 421 days.

(21) Appl. No.: 11/290,167

(22) Filed: Nov. 30, 2005

(65) Prior Publication Data

US 2007/0122208 A1 May 31, 2007

(51) Int. Cl.
*G03G 15/09* (2006.01)
*G03G 21/18* (2006.01)
*G03G 15/04* (2006.01)

(52) U.S. Cl. ..... 399/272; 399/115; 399/119

(58) Field of Classification Search ..... 399/119, 399/120, 271, 272, 115
See application file for complete search history.

(56) References Cited

U.S. PATENT DOCUMENTS 4,615,606 A * 10/1986 Nishikawa ..... 399/272
4,868,600 A 9/1989 Hays et al.
5,276,488 A 1/1994 Schmidlin
5,504,563 A 4/1996 Hays
5,525,752 A * 6/1996 Izumizaki et al. ..... 399/275
5,625,439 A * 4/1997 Murakami ..... 399/272
5,656,409 A 8/1997 Christy et al.
5,887,233 A 3/1999 Abe et al.
5,899,608 A 5/1999 Eklund et al.
6,208,825 B1 3/2001 Hays
6,223,013 B1 4/2001 Eklund et al.
6,377,768 B1 4/2002 Hulin et al.

FOREIGN PATENT DOCUMENTS

JP 62279375 A * 12/1987

OTHER PUBLICATIONS

U.S. Appl. No. 11/081,034, filed Mar. 16, 2005, by Dan A. Hays, Systems and Methods for Electron Charging Particles.

* cited by examiner

*Primary Examiner*—David M Gray
*Assistant Examiner*—Joseph S. Wong

(57) ABSTRACT

A development system for an electrophotographic machine in which uncharged toner is stored in a housing having an opening. A rotatable dispensing roll is mounted in the housing opening. An overhung metering blade mounted at the housing opening meters a layer of uncharged toner onto the dispensing roll. An ion or electron charging device places a charge on the toner layer residing on the dispensing roll prior to the transportation thereof by the dispensing roll to a captive magnetic brush. The magnetic brush transports the two component developer on the magnetic brush to a development zone for either direct development of a latent image on a moving imaging surface or to coat donor rolls for AC/DC generated toner cloud development of a latent image.

19 Claims, 9 Drawing Sheets

TWO COMPONENT DEVELOPMENT SYSTEM USING ION OR ELECTRON CHARGED TONER

BACKGROUND OF THE INVENTION

An exemplary embodiment of this application relates to a development system for an electrophotographic reproducing machine. More particularly, the exemplary embodiment relates to a two component development system in which either ion or electron charged toner is dispensed onto a magnetic brush having magnetic carrier beads thereon to form a two component developer. The magnetic brush with the two component developer may be used to either directly develop an electrostatic latent image or to coat donor rolls for AC/DC generated toner cloud development of an electrostatic latent image.

One type of electrophotographic reproducing machine is a xerographic copier or printer. In a typical xerographic copier or printer, a photoreceptor surface is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is prepared to be used once again for the reproduction of a copy of an original. The paper with the powdered toner thereon in imagewise configuration is separated from the photoreceptor and moved through a fuser to permanently fix or fuse the toner image to the paper.

Xerographic development systems normally fall into two categories; viz., those that use a combination of carrier beads and toner particles for two component developer material and those that use only toner particles for the developer material. In two component development systems, the carrier beads are usually magnetic and the toner particles are usually nonmagnetic, but triboelectrically adhere to the carrier beads. The toner particles are attracted to the electrostatic latent image from the carrier beads and form a toner particle image on the photoreceptor surface. In single component development systems, the toner particles are usually triboelectrically charged and generally are required to jump a gap to develop the electrostatic latent image on an image surface. Most single component development systems cause the charged toner particles to be transported to a development zone where they are caused to form a toner cloud by the action of an AC electric field. A combination of AC and DC electrical biases attract the charged toner particles in the toner cloud to the electrostatic latent image on image surface, thereby developing the image and rendering it visible.

In the electrophotographic industry, the phenomenon of triboelectricity is widely used to charge toner particles. Triboelectric charging of the toner particles is obtained by aggressively mixing the toner particles with the larger carrier beads when a two component developer material is used or by rubbing the toner particles between a doctor blade and a donor member when a single component developer material is used.

Typically, a magnetic brush development system has a sleeve that axially rotates with fixed internal magnets that attract magnetic carrier beads thereto from a sump and transport them to a development zone adjacent a movable photoreceptor. Non-magnetic particles of toner are triboelectrically attracted to the carrier beads, and as the toner particles, hereafter called toner, enters the development zone, the toner is attracted from the carrier beads to the electrostatic latent image on the confronting surface of the photoreceptor. In this configuration, the electrostatic latent image on the photoreceptor is directly developed by the two component developer on the magnetic brush.

In the image-on-image process, development of full color or multicolor electrostatic latent images requires non-interactive development systems to prevent the disturbance and contamination of previously developed image portions. Generally, full color electrostatic latent images are generally composed of a set of scanned images serially superimposed on top of each other. Each of the scanned images represent one color of the multicolor original document. Usually the magenta image portion of the latent image is developed first, followed by a yellow portion, then cyan, and finally black. Clearly, the first developed image must not be disturbed by the subsequently developed image nor must there be cross contamination of the toner images.

The type of development systems which do not disturb or cross contaminate the images as they are separately developed are referred to as non-interactive development devices and primarily relate to various powder cloud development systems. There are a number of well known non-interactive development systems, such as, for example, the scavengeless development devices as disclosed in U.S. Pat. No. 4,868,600 and U.S. Pat. No. 5,504,563. Some scavengeless development systems require stationary wire electrodes located in the toner clouds, while others types require interdigitated electrodes on donor rolls addressed by a commutator.

As mentioned above, one type of single component development is referred to as jumping development. Jumping development systems attract triboelectrically charged toner from a sump onto an axially rotated donor roll which rotates the charged toner to a location spaced from but adjacent a electrostatic latent image on a moving photoreceptor. The toner is attracted from the donor roll to the electrostatic latent image by a combination of AC and DC electric fields applied across the space or gap. Such commercial development systems as magnetic brush or jumping single component development systems with an AC electric field may interact with the photoreceptor and a previously toned image will be scavenged by subsequent development.

There are many existing scavengeless development systems that prevent interaction of the development system with the previously developed image. For example, U.S. Pat. No. 4,868,600 discloses a scavengeless development system in which toner detachment from a donor roll and the concomitant generation of a toner cloud is obtained by AC electric fields supplied by spaced wire electrodes positioned in close proximity to the donor roll and within the space between the donor roll and the photoreceptor surface containing the electrostatic latent image. In another example, U.S. Pat. No. 5,276,488 discloses a scavengeless development system in which toner is detached from a donor belt and attracted to an electrostatic latent image carried by a moving photoreceptor positioned adjacent the belt. Generation of a toner cloud is effected using AC electric fields created by applying an AC voltage between an embedded interdigitated electrode structure and a shoe stationarily positioned behind the donor belt, while U.S. Pat. No. 5,504,563 discloses a scavengeless or non-interactive development system in which an AC bias is applied between neighboring interdigitated electrodes embedded in a rotating donor roll or belt.

U.S. Pat. No. 5,656,409 discloses a method of applying non-magnetic and non-conductive toner to a rotating image containing cylinder having an electrostatic pattern thereon. The toner is contained in a container where it is fluidized and then charged by using electrically biased rotating paddle wheels to stir and charge the fluidized toner. The charged toner is transferred from the container to the rotating image containing cylinder by biased rotating cylinders.

U.S. Pat. No. 5,887,233 discloses several embodiments of devices that charge a toner layer in a single component development system. Each embodiment contains an electrification control member interposed between a charge imparting member and toner layer on a carrying roll.

U.S. Pat. No. 5,899,608 discloses a single component development system for a xerographic copier or printer having a rotatable donor roll with interdigitated electrodes. A portion of the donor roll is positioned adjacent a supply of fluidized toner contained in a housing and another portion of the donor roll is positioned at a development zone where it is adjacent a movable surface containing an electrostatic latent image. The electrodes on the donor roll may be biased to attract a layer of toner thereto. As the donor roll is rotated, the toner layer is charged by a corona-generating device and transported to the development zone. At the development zone, the electrodes are biased to produce a toner cloud to develop the latent image.

U.S. Pat. No. 6,208,825 discloses a single component development apparatus for developing electrostatic latent images on an image bearing surface. The apparatus includes a sump containing toner, a rotatable donor member having electrodes on the surface thereof for transporting toner through a development zone, and electrical biases for charging the toner in the sump. The electrodes on the donor member produce fringe fields for depositing toner on the donor member, while devices located in the development zone form a toner cloud to develop the latent image on the image-bearing surface. The apparatus further provides an electrostatic filtering zone located upstream from the development zone for removal of wrong-sign charged toner from the donor member.

U.S. Pat. No. 6,223,013 discloses a wireless hybrid scavengeless development system for developing a latent image recorded on an imaging surface in which a two component development system is used to place a uniform layer of toner onto a donor belt or roll. An electrical bias is used to load toner on the donor belt or roll. Triboelectric charging of the toner in a sump is used to assist loading of the toner onto a magnetic brush. The thickness of the toner layer on the donor belt or roll is controlled by toner concentration in the sump and an electrical bias between the donor belt or roll and the magnetic brush. Ion charging thus overwhelms the previous triboelectric charge of the toner and the donor belt or roll transports the charged toner to a development zone, whereat a toner cloud is produced to develop the latent image on the imaging member.

U.S. Pat. No. 6,377,768 discloses a development system for developing an electrostatic latent image on an image bearing surface using a movable donor roll uniformly coated with charged toner from a toner spraying device that is analogous to a powder coating mechanism. The donor roll with the toner layer is transported past a corona device to uniformly charge the toner layer and onto a development zone. The development zone is adjacent the image bearing surface where the charged toner is transferred to the latent image on the image bearing surface.

U.S. patent application Ser. No. 11/081,034 filed Mar. 16, 2005 by Dan A. Hays, SYSTEMS AND METHODS FOR ELECTRON CHARGING PARTICLES discloses systems for charging toner particles used, for example, in copying and printing machines by transporting air entrained toner particles through an electron charging device incorporating two spaced, parallel electrodes. At least one electrode is connected to an AC voltage source and at least one of the electrodes is coated with or comprised of nanotubes oriented perpendicular to the direction of entrained toner particles.

The problem with triboelectric charging of toner, as used in the known prior art, is that it causes high adhesion that limits efficient xerographic image development and electrostatic transfer of the developed image from the photoreceptor to the recording medium, such as paper. In addition, triboelectric charging toner with carrier beads requires aggressive mixing to achieve adequate charging and high shear forces are generated during the mixing and subsequent metering of the two component developer onto the magnetic brush. The high shear forces cause toner fragmentation or attrition as well as embedding of toner surface additives into the toner particles that leads to degradation in the development system performance. To achieve adequate triboelectric charging, surface additives are necessary and such additives cause the toner to be further impacted or affected by the relative humidity of the operating environment.

SUMMARY OF THE INVENTION

It is an object of an exemplary embodiment of this application to provide a development system incorporating a captive magnetic brush in which either gaseous ion or electron charged toner is dispensed onto carrier beads magnetically held onto the magnetic brush to form a two component developer thereon. The two component developer with the ion or electron charged toner may be used either to develop directly an electrostatic latent image or to toner donor rolls for subsequent toner cloud development of an electrostatic latent image.

In one aspect of the exemplary embodiment, there is provided a two component development system for developing an electrostatic latent image recorded on an imaging surface of an electrophotographic machine, comprising: a rotatable magnetic brush having magnetic carrier beads thereon; a housing for storing a supply of substantially uncharged toner and having an opening therein; at least one rotatable toner dispensing roll positioned in said housing opening and being in contact with said toner; a metering blade mounted at said housing opening and in contact with said at least one dispensing roll for metering said toner thereon; an ion or electron charging device adjacent said at least one toner dispensing roll for charging said toner thereon; and said at least one toner dispensing roll transporting said ion or electron charged toner thereon to said magnetic brush for transfer thereto, said ion or electron charged toner being uniformly dispersed by said carrier beads on said magnetic brush to provide a uniformly deposited layer thereon.

BRIEF DESCRIPTION OF THE DRAWINGS

An exemplary embodiment of this application will now be described, byway of example, with reference to the accompanying drawings, in which like reference numerals refer to like elements, and in which.

DESCRIPTION OF THE PREFERRED EMBODIMENT

Figure 1:
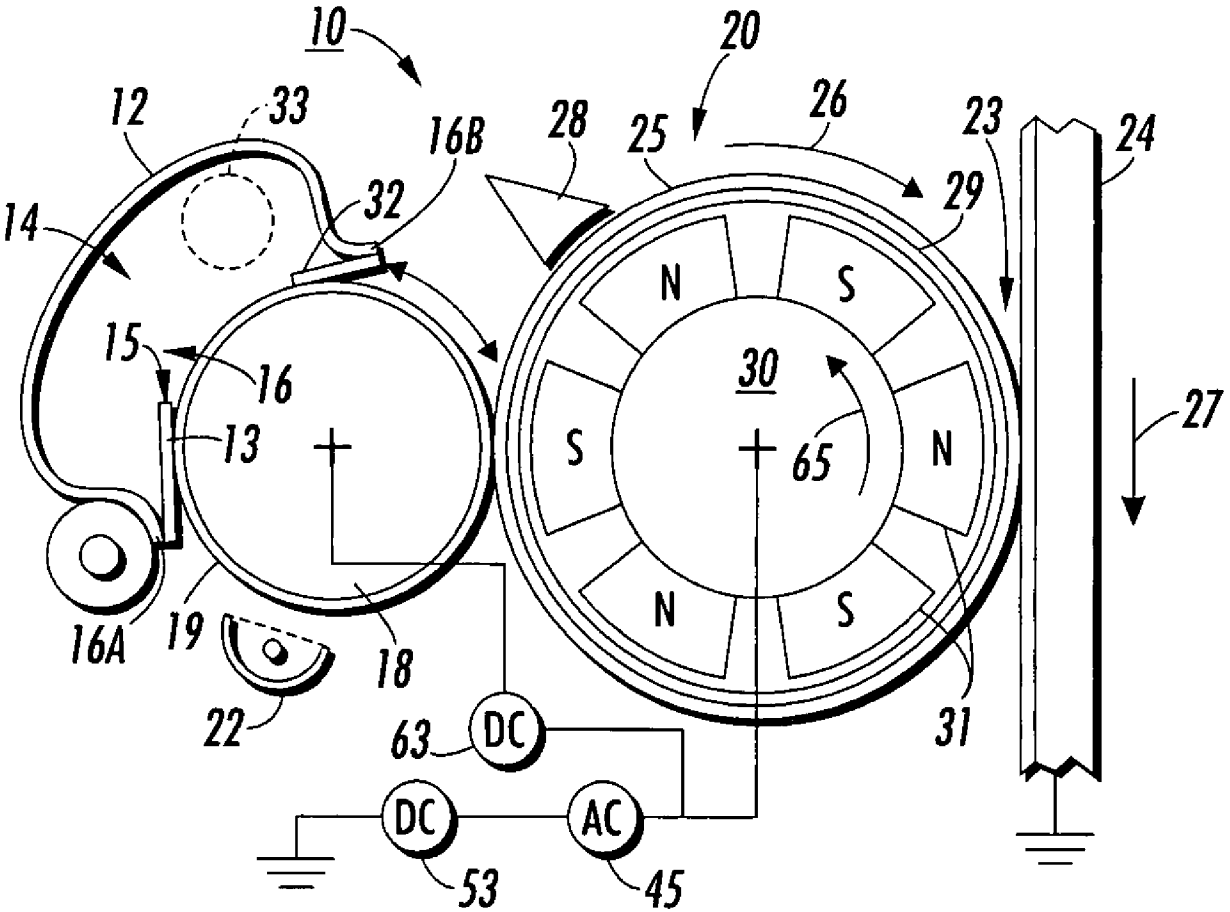
FIG. 1 is a schematic elevation view of an illustrative development system according to this application for use in an electrophotographic machine.

FIG. 1 schematically depicts an elevation view of an illustrative embodiment of a two component development system 10 according to this application for use in a typical electrophotographic copier or printer. The development system 10 includes a captive magnetic brush 20 onto which is dispensed an ion or electron charged toner 14. By captive magnetic brush, it is meant that the carrier beads (not shown) remain on the rotatable tubular member 29 of the magnetic brush 20, while the charged toner 14 may be dispensed thereon or removed therefrom, as discussed later. The development system 10 comprises a housing 12 containing a supply of substantially uncharged toner 14 and having an elongated opening 16 substantially closed by a toner dispensing roll 18 that is mounted for rotation therein. The housing 12 is generally above the toner dispensing roll 18, so that the loading of the uncharged toner 14 onto the dispensing roll 18 is assisted by gravity. The housing opening 16 is sufficiently wide to prevent the toner therein from bridging and restricting to flow of toner to the dispensing roll. Thus, the dispensing roll 18 remains in contact with the toner 14 at all times.

A layer of toner 14 is metered onto the dispensing roll 18 from the housing 12 by an overhung metering blade 13 fixedly mounted along one edge or lip 16A of the housing opening 16. The contact point of the metering blade 13 with the dispensing roll 18 is at a location spaced from its distal end 15, so that toner is wedged underneath the blade to form a toner metered layer 19 on the dispensing roll 18. The amount of overhang of the distal end 15 of the metering blade 13 determines the thickness of the metered layer of toner on the dispensing roll. Thus, the dispensing roll 18, as viewed in FIG. 1, is rotated in the counterclockwise direction by any suitable means, such as by an electric motor (not shown).

At a location downstream from the metering blade 13, a wire scorotron 22 is depicted as an example of any suitable ion or electron charging device. The scorotron 22 places a charge on the layer of toner on the dispensing roll 18 as the dispensing roll is rotated therepast. A rotatably mounted magnetic brush 20 is positioned in contact with the toner layer 19 on the dispensing roll 18 at a location on the dispensing roll that is generally opposed to the housing opening 16. The magnetic brush 20 has a length at least equal to the copier or printer process or printing width. Thus, the magnetic brush extends across the width of the imaging surface of copier or printer. An electrical bias for the magnetic brush is provided by DC voltage source 53 and AC voltage source 45, while an electrical bias for the dispensing roll 18 by DC voltage source 63 in combination with DC voltage source 53 and AC voltage source 45. The difference in the electric potential of the dispensing roll 18 and the magnetic brush 20 causes the electrostatic transfer of charged toner from the dispensing roll to the magnetic brush.

The charged toner on the dispensing roll 18 downstream of the scorotron 22 is dispensed to a captive layer of carrier beads (not shown) of the magnetic brush 20 to form a layer of two component developer 25 thereon. Rotation of the magnetic brush in the direction of arrow 26 transports the two component developer to a development zone 23. The magnetic pole pieces 31 on cylindrical member 30 are rotated in the opposite direction to the rotation of the tubular member 29 having the carrier beads thereon as indicated by arrow 65. This opposite rotation of the magnetic pole pieces 31 assists the lateral diffusion of charged toner on the carrier beads, so that the charged toner is maintained substantially uniform among the carrier beads. An electrostatic latent image on an electrically grounded, movable imaging surface 24, such as, for example, a photoreceptor, may be developed at the development zone 23 as the imaging surface is moved there past in the direction of arrow 27.

Magnetic brushes are well known, so the construction of magnetic brush 20 need not be described in great detail. Briefly, the magnetic brush comprises a rotatable tubular member 29 for carrying the carrier beads (not shown) on its outer surface. A rotatable magnetic cylinder 30 having a plurality of alternately polarized magnetic pole pieces 31 impressed around its outer surface is located within the tubular member 29. The magnetic cylinder 30 could be held stationary, but the rotation counter to that of the tubular member 29 assists in the lateral diffusion of the charged toner with the carrier beads to maintain a relative uniform layer of two component developer 25 on the magnetic brush 20. The carrier beads of the two component developer 25 are magnetic and either conductive or semi-conductive. As the tubular member 29 of the magnetic brush 20 rotates in the direction of arrow 26 and the cylindrical member 30 rotates in the direction of arrow 65, the carrier beads, together with a difference in the electrical bias between the dispensing roll 18 and magnetic brush 20, attract the charged toner 14 thereto from the dispensing roll 18. The charged toner 14, once attracted to the carrier beads of the magnetic brush, adheres thereto. The charge on the toner electrostatically induces a counter charge in the carrier beads, provided the carrier beads have sufficient conductivity, and thus the net charge of the two component developer 25 is essentially zero. The rotation of the tubular member 29 and cylindrical member 30 of the magnetic brush 20 may be provided by any suitable means, such as, for example, one or more electric motors (not shown). Thus, the two component developer 25 is conveyed to the development zone 23 by the magnetic brush 20 for development of an electrostatic latent image on the imaging surface 24 moving past the development zone.

In accordance with this application, the dominant toner charge is provided by either ion or electron charging with substantially no triboelectric charging interaction between the toner and carrier beads. Without the need to triboelectrically charge toner, no sump with augers is required for aggressive mixing and toner triboelectric charging. Generally, for the embodiment of this application, there is no need for carrier bead coating, and the amount and type of toner surface additives can be reduced from that normally required for triboelectric charging and stability. The toner for this application is about 8 nm size silica and preferably CAB-O-SIL TS® available from Cabot Corporation that is treated fumed silica. The surface additive concentration is in the range of 0.1 to 0.3% by weight. The reduced toner-surface additives also enable lower cost toner. In order to provide a dominant toner charge by ion or electron charging, the electric field due to the ion or electron charged toner should suppress any slight triboelectric charging and the embodiments in this application invoke this effect.

During charged toner dispensing to the magnetic brush, an electrical bias is provided between the dispensing roll 18 and the magnetic brush 20. An AC voltage source 45 and DC voltage source 53 is applied to the magnetic brush, while a DC voltage source 63 is applied to the dispensing roll 18 in combination with the AC voltage source 45 and DC voltage source 63. This difference in electrical potential between the dispensing roll and magnetic brush assists in removing the charged toner from the dispensing roll. A wiper blade 32 is mounted on a lip 16B of the housing opening 16 that is opposite the housing lip 16A on which the metering blade 13 is mounted. The wiper blade 32 acts as a plow or doctor blade to remove toner from the donor roll 18 when it is rotated in the clockwise direction. The wiper blade 32 can be used as a doctor blade when the magnetic brush and toner dispensing roll are biased to detone the magnetic brush for system shutdown for extended periods, thereby preventing toner charge decay.

In one embodiment, the housing 12 containing the uncharged toner 14 and toner dispensing roll 18 could have the same width as the process width and, therefore, the same width as the magnetic brush 20. A full width housing 12 would be stationary with additional toner added as needed into the housing 12 through aperture 33, shown in dashed line, from a supply container (not shown). In this embodiment, the concentration of toner in the magnetic brush is self regulated along the axial direction thereof, especially when the magnetic pole pieces 31 and cylindrical member 30 are rotated in a direction opposite the direction of the tubular member 29, as indicated by arrows 65 and 26, respectively. Furthermore, it is believed that there is natural lateral diffusion of the charged toner within the developer 25, so that the toner concentration in the axial direction is suitably uniform.

Figure 2:
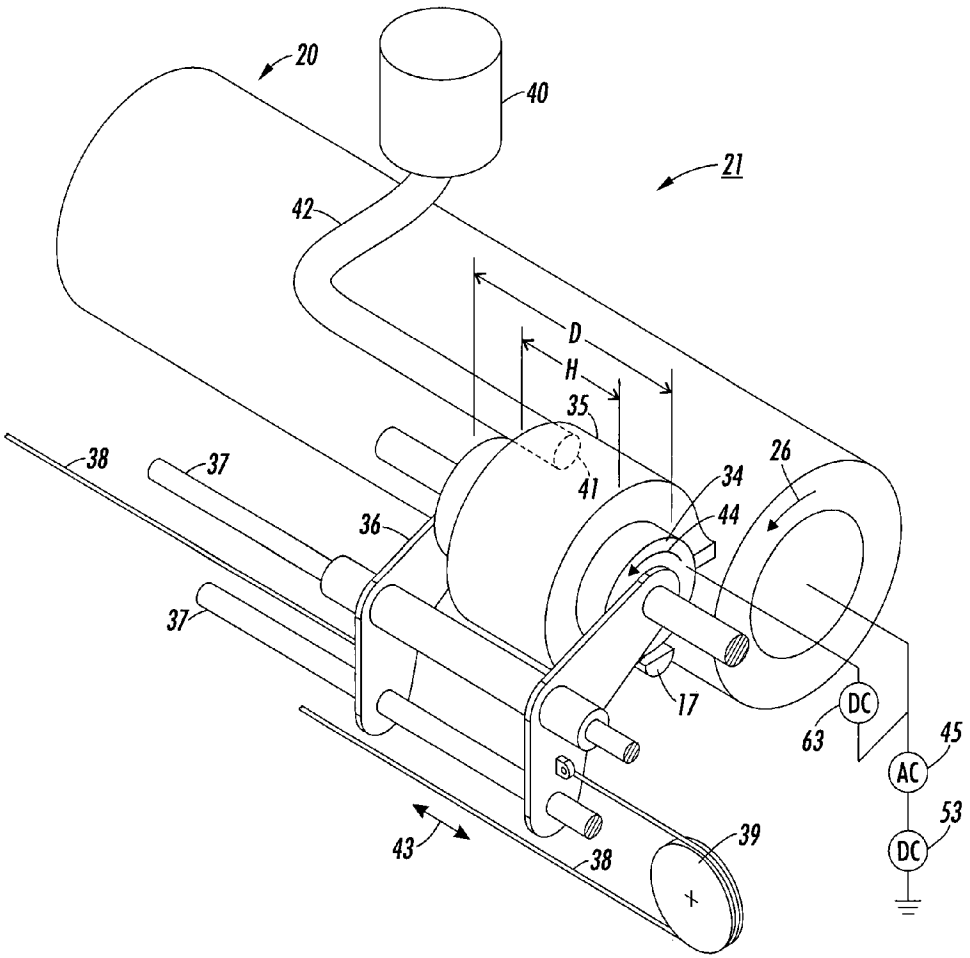
FIG. 2 is a schematic isometric view of an alternate embodiment of the development system shown in FIG. 1, the alternate embodiment having a toner supply and dispensing roll with an ion or electron charging device mounted together on a translatable carriage for translation thereby to selectively dispense ion or electron charged toner to toner-depleted regions on the magnetic brush.

In another embodiment, shown in the isometric view of FIG. 2, a second development system 21 has a housing 35 and dispensing roll 34 which are a fraction of the developing process width, as represented by magnetic brush 20. The housing 35 and dispensing roll 34 are similar to the housing 12 and dispensing roll 18 of FIG. 1, though shorter in length, and have the same relative position to each other and function in the same manner. The difference between the embodiment shown in FIG. 2 and the embodiment in FIG. 1 is that the housing 35 and dispensing roll 34 are not only shorter in length, but they are mounted on a translatable carriage 36. Accordingly, in FIG. 2, a dispensing roll 34 having a width "D" of about 5 to 15 cm is depicted, together with a housing 35 having a width "H" that is less than width D. Both are mounted on a translatable carriage 36. Similarly to the embodiment shown in FIG. 1, the housing 35 has an opening with opposing lips (not shown) on which a metering blade and a wiper blade are respectively mounted, neither shown in this view. Also mounted on the carriage 36 is an ion or electron charging device 17, such as, for example, a scorotron. The charging device 17 is mounted downstream from a metering blade (not shown) and is fixed relative to the dispensing roll 34. The carriage 36 is slidingly mounted on guide rails 37 and may be translated by any suitable means, such as, for example, by a cable 38 connected on opposing sides of the carriage 36 that is entrained about an idler pulley (not shown) and a driven pulley 39. The driven pulley may be rotated by, for example, a reversible electric motor (not shown) to shuttle the carriage back and forth along the guide rails 37 in a manner analogous to a carriage type ink jet printer, as indicated by arrow 43.

In this way, the dispensing roll 34 may selectively meter charged toner from the relatively narrow housing 35 onto sections of the magnetic brush 20 where toner additions are needed. The magnetic brush sections needing to be re-supplied with charged toner may be determined, for example, by a toner concentration sensor 28 (see FIG. 1) and/or in combination with feed-forward image content data supplied to a controller (not shown) as is well known in the industry. The housing 35 is periodically re-filled with uncharged toner through aperture 41 (shown in dashed line). The re-filling may be accomplished by either a fixed supply bottle (not shown) located at a station at one end of the guide rails 37 or by toner supply bottle 40 and a flexible tube 42 with a rotatable spiral transporter therein (not shown). The flexible tube 42 interconnects the toner supply bottle 40 and the housing aperture 41 and provides a constant re-supply of uncharged toner 14 to keep the housing 35 filled with toner.

The dispensing roll 34 is positioned and rotated by an electric motor (not shown) at a rate that is sufficient to replenish the ion or electron charged toner on the magnetic brush 20 that has been lost by development of an electrostatic latent image on the imaging surface. It is known, for example, that there is little or no development required at the outboard and inboard ends of the process widths containing the electrostatic latent images, so very little charged toner on the magnetic brush will be used at these locations.

Just as described for the embodiment in FIG. 1, the uncharged toner from housing 35 is metered onto the dispensing roll 34 by a metering blade (not shown) that is similar to, but shorter than, the metering blade 13 of FIG. 1. Also, the uniform layer of uncharged toner metered onto the dispensing roll 34 is charged by an ion or electron charging device 17, such as, for example, a scorotron. Charging device 17 is also mounted on the carriage 36 and is located downstream from the metering blade mounted on the housing 35 as the dispensing roll 34 is rotated in the direction of arrow 44. During the dispensing of charged toner to the magnetic brush 20 from the dispensing roll 34, an electrical bias is applied between the dispensing roll and the magnetic brush by a DC voltage source just as in the embodiment of FIG. 1. Similarly to the embodiment of FIG. 1, a wiper blade (not shown) oriented in a doctor blade (plow) mode is employed to detone the dispensing roll 34 when the dispensing roll 34 is rotated in a direction opposite to arrow 44 for system shutdown for extended periods to prevent toner charge decay.

Figure 3:
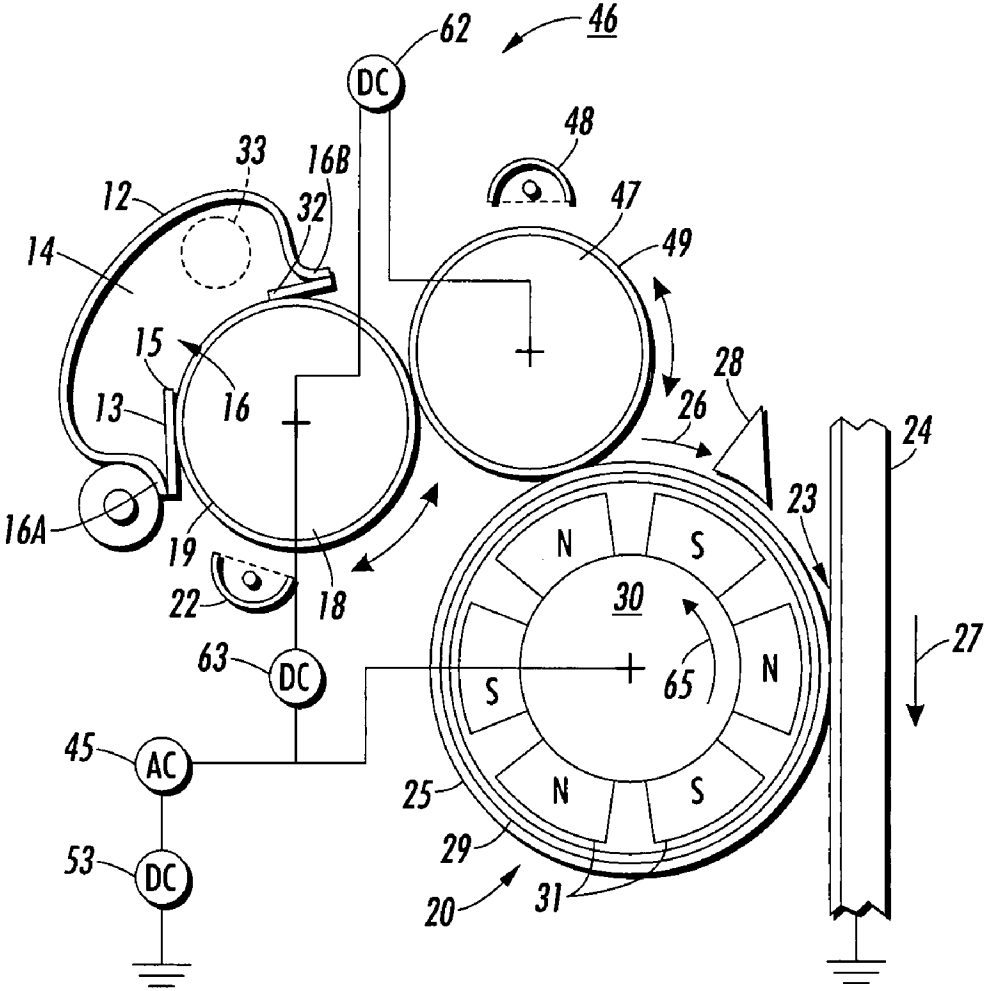
FIG. 3 is a schematic elevation view of a second embodiment of the development system shown in FIG. 1 containing a second dispensing roll for more uniformly charging of the toner.

In FIG. 3, a schematic elevation view of a third embodiment of the development system is shown. The difference between the development system 46 of FIG. 3 and the development systems of FIGS. 1 and 2, is that a rotatable second dispensing roll 47 is located between dispensing roll 18 or dispensing roll 34 and the magnetic brush 20. The second dispensing roll 47 is the same size as the dispensing roll 18, if the third embodiment 46 has a full width, stationary housing 12. Conversely, if the second dispensing roll 47 is used in a configuration similar to FIG. 2, it is the same size as associated dispensing roll 34 and also mounted on the translatable carriage 36 for translation therewith. Since the operation of the second dispensing roll 47 is the same, whether it is used in a development system similar to FIG. 1 or the development system of FIG. 2, the dispensing roll 47 will be described in accordance with a configuration similar to FIG. 1; viz., with a full width housing 12 and dispensing roll 18. The charged toner layer 19 on dispensing roll 18 is transferred to the second dispensing roll 47 as toner layer 49 with the assistance of an electrical bias provided by DC voltage source 62. The toner layer 49 on the second dispensing roll 47 is then charged by another charging device 48, such as, for example, a scorotron. Of course, the charging device 48 would also be mounted on the carriage 36 if a configuration similar to FIG. 2 is used (see for example FIG. 9).

The charging of the metered toner layer on either dispensing roll 18 or 47 can be obtained with a variety of charging devices including a wire or pin corotron or screen scorotron with an in-situ manual or automatic brush or wiper (not shown) that periodically cleans the corotron wire or pins and scorotron screen. In addition, the metered layer of toner can be charged by a charge imparting member (not shown) having an electrification control member interposed between it and the dispensing roll as disclosed in U.S. Pat. No. 5,887,233 which is incorporated herein by reference in its entirety.

Field emission from carbon nanotubes provide an alternative charging method that can be used to charge the toner layers 19, 49 on the dispensing rolls 18,47, respectively. The toner layer charging can be by either direct electron charging or indirect ion charging in which the field emitted electrons are either captured on electronegative gas molecules or the high fields at the tips of the carbon nanotubes can be used to ionize gas molecules. Because the electric field is highly intensified at the nanotube ends, the electron field emission occurs at voltages of only a few hundred volts across gaps of hundreds of micrometers. A charging device incorporating nanotubes may also be used to charge the metered toner layers 19,49 on the dispensing rolls of this application as disclosed in U.S. patent application Ser. No. 11/081,034 filed Mar. 16, 2005 by Dan A. Hays, SYSTEMS AND METHODS FOR ELECTRON CHARGING PARTICLES, the relevant portions thereof are incorporated herein by reference.

Figure 7:
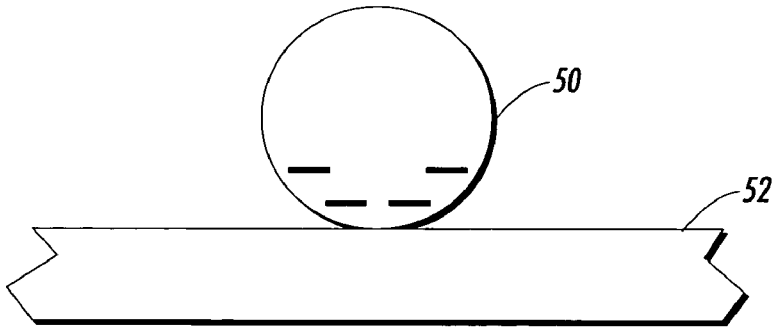
Figure 8:
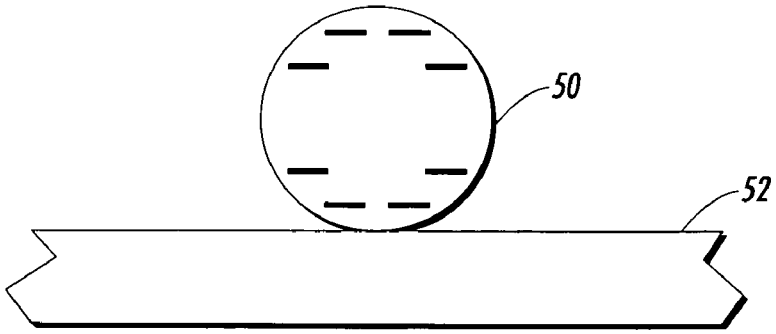

The development system as illustrated in FIG. 1 deposits charge on the top of the toner 14 in a toner layers 19 before transfer to the magnetic brush 20. Although such charged toner will exhibit reduced toner particle adhesion compared to triboelectrically charged toner, even greater reduction of adhesion (for a given charge level) will be achieved, if the toner is more uniformly charged. To more uniformly charge toner on a substrate, such as a dispensing roll 18, the top side of the charged toner can be electrostatically transferred to a second dispensing roll 47. The transfer to the second dispensing roll 47 causes the charge on the charged toner to be near the surface of the second dispensing roll, and the charged toner is charged again to more uniformly charge the entire toner particle surface. This charging sequence in the embodiment disclosed in FIG. 3 is illustrated in FIGS. 6 through 8.

Figure 6:
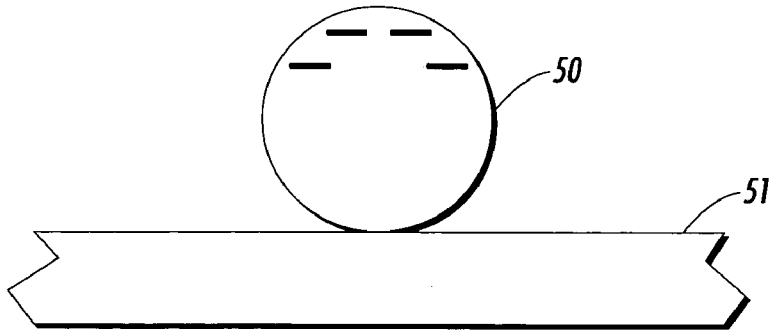
FIGS. 6 to 8 schematically shows the toner charging according to the embodiments shown in FIGS. 3 and 5.

In FIG. 6, a single toner particle 50 is depicted as a spherically shaped and residing on a surface 51 representing dispensing roll 18 that has been charged by a charging device, such as, scorotron 22. This places the charge, in this illustration negative, on top of the toner particle as indicated by minus signs. In FIG. 7, the charged toner particle 50 has been transferred to a second surface 52 representing the second dispensing roll 47. FIG. 8 shows the toner particle 50 after it has been charged again by a second charging device, such as scorotron 48. The second charge clearly shows a more uniformly charged toner that will have a reduced adhesion.

Figure 4:
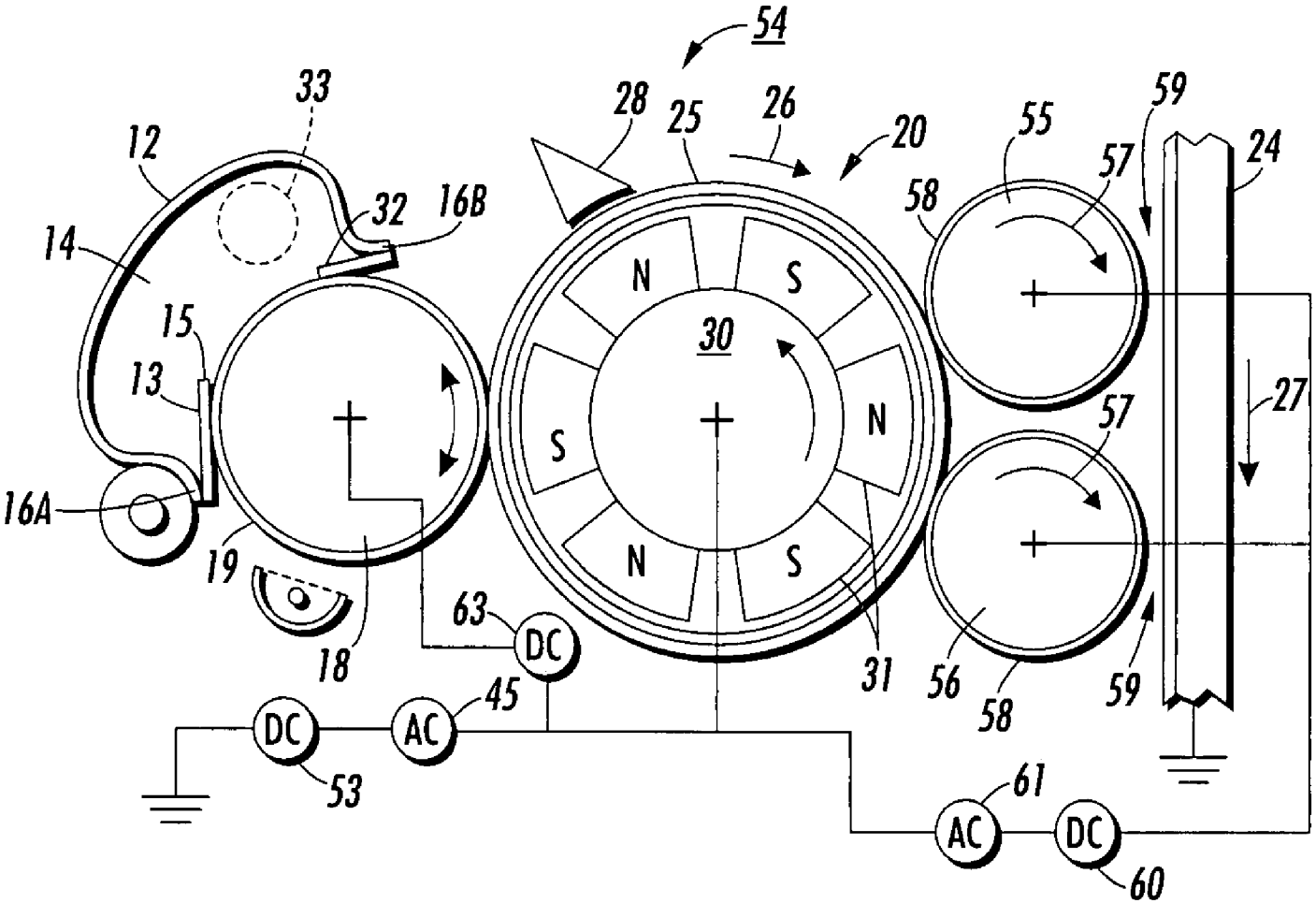
FIG. 4 is schematic elevation view of a third embodiment of the development system shown in FIG. 1 incorporating a pair of donor rolls for scavengeless development by the development system.

FIG. 4 shows a fourth embodiment of the development system of this application. The development system 54 shown in FIG. 4 is similar to the embodiment in FIGS. 1 and 2, except a pair of rotatable donor rolls 55, 56 are positioned between the magnetic brush 20 and the imaging surface having the electrostatic latent image thereon. The donor rolls 55,56 are in contact with the magnetic brush, but spaced from the imaging surface to provide a development zone 59 in which a toner cloud will be produced for development of the latent image.

As the donor rolls 55,56 rotate in the direction of arrows 57, a DC or DC plus AC bias is applied to the donor rolls to electrostatically transfer the toner thereto from the magnetic brush 20 by DC and AC voltage sources 60,61, respectively. The donor rolls generally consist of a conductive aluminum core covered with a thin insulating anodized layer having a thickness of about 50 μm. The magnetic brush 20 is held at an electrical potential difference relative to the donor rolls to produce the field necessary for toner to be attracted from the magnetic brush. The amount of toner deposited on the donor rolls is controlled by the toner concentration in the two component developer 25 on the magnetic brush 20 and the bias between the donor rolls 55,56 and the magnetic brush. The typical thickness of the toner layer 58 on the donor rolls 55,56 is between 1 and 3 monolayers. As donor rolls 55,56 are rotated from the magnetic brush in the direction of arrows 57, the charged toner layers 58 are moved into development zone 59 defined by the gap, the donor rolls and the imaging surface 24, such as a photoreceptor. The development gap is typically in the range of 0.125 and 0.75 mm. The toner layers 58 on the donor rolls 55, 56 are then disturbed by AC/DC electric fields applied to the donor rolls by a combination of the DC and AC voltages from DC voltage source 53 and AC voltage source 45, together with the DC voltage source 60 and AC voltage source 61, so as to produce an agitated cloud of toner in a manner well known in the imaging industry. Furthermore, the toner cloud may be produced by any known methods, such as the process disclosed in U.S. Pat. No. 4,868,600 incorporated herein by reference in its entirety. Toner from the toner cloud is then developed onto the electrostatic latent image on the imaging surface 24 by fields created thereby.

In the embodiment shown in FIG. 4, a magnetic brush 20 is used to provide a two component developer to load a uniform layer of toner onto a pair of donor rolls 55,56. The same electrical bias between the magnetic brush 20 and dispensing roll 18, as described with respect to FIG. 1, may be used to attract the ion or electron charged toner from the dispensing roll 18. DC and AC voltage sources 60,61, respectively, assist in the transfer of the toner from the magnetic brush to the donor rolls and provide the electric fields to produce the toner clouds at the development zones 59. The voltage sources 60,61 each provide an electrical bias of 0 to 1000 volts.

Figure 5:
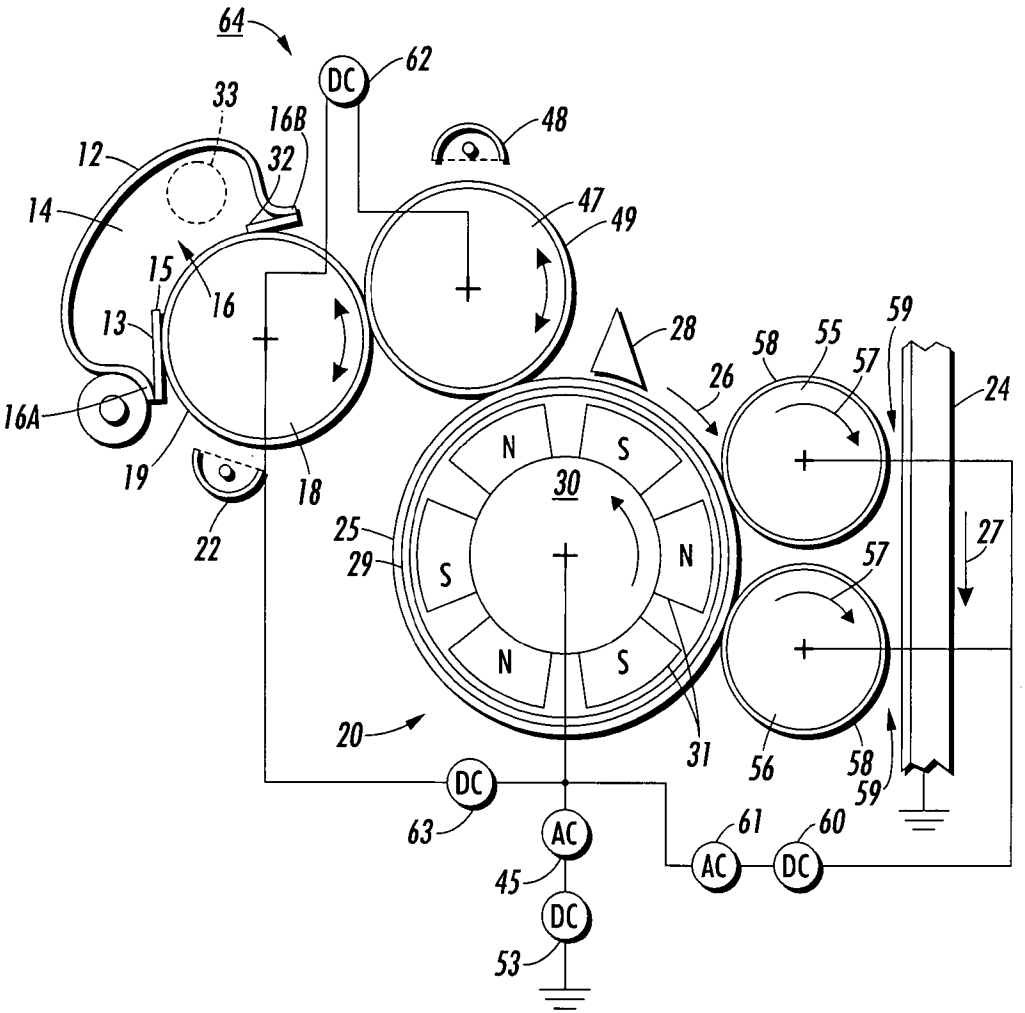
FIG. 5 is a schematic elevation view of a fourth embodiment of the development system shown in FIG. 1 containing a second dispensing roll and incorporating a pair of donor rolls for scavengeless development by the development system.

Referring to FIG. 5, a fifth embodiment of the development system of this application is shown as development system 64. The development system 64 is similar to the development system 54 illustrated in FIG. 4, except it has a second dispensing roll 47 that is identical to the second dispensing roll and electrical bias as described for the development system 46 shown in FIG. 3. As discussed with respect to development system 46, the second dispensing roll 47 provides a more uniformly ion or electron charged the toner 14 in toner layer 49 thereon.

Figure 9:
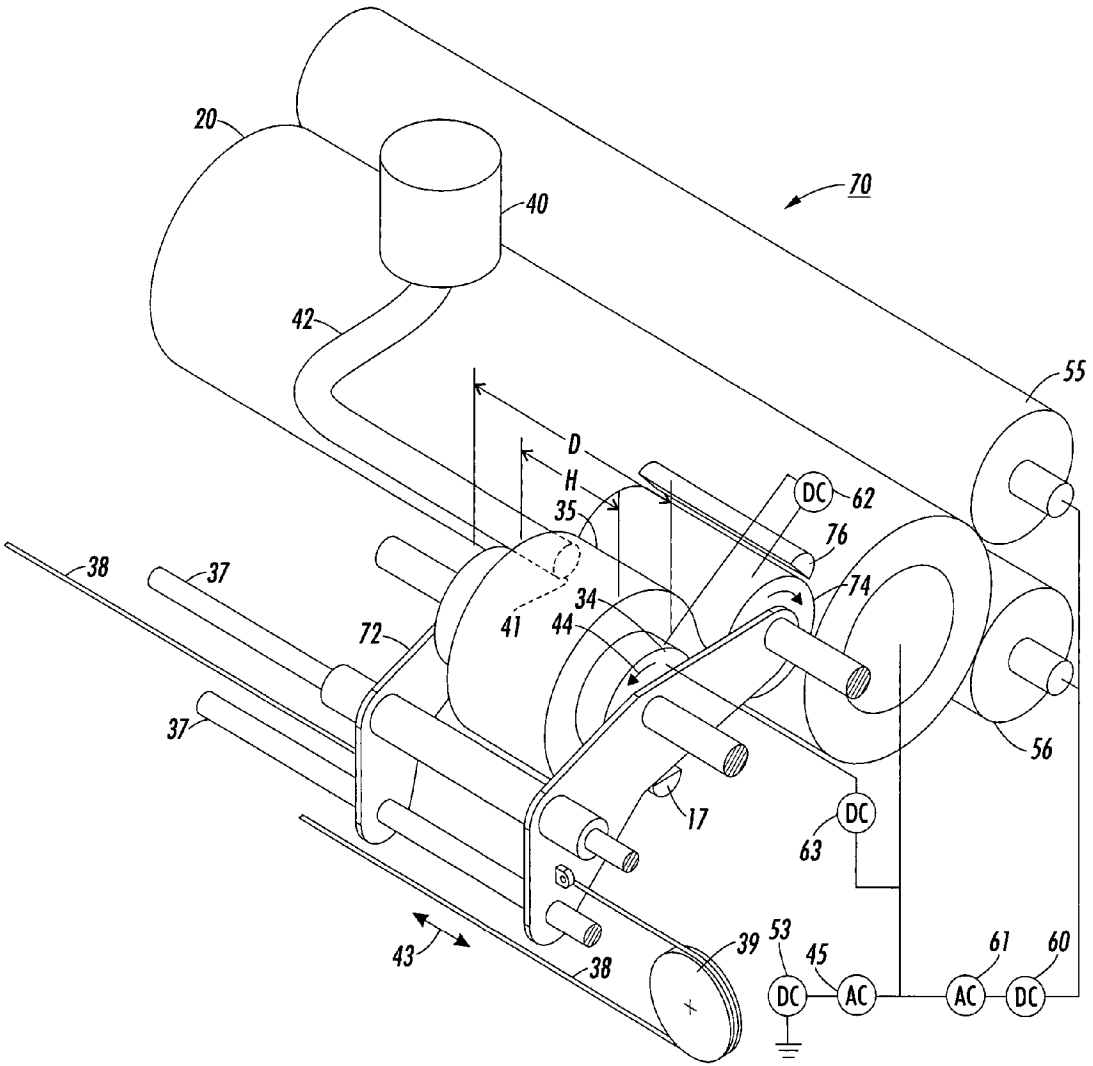
FIG. 9 is a schematic isometric view of another embodiment of the development system shown in FIG. 2 in which a second dispensing roll and second ion or electron charging device is also mounted on a translatable carriage.

Referring to FIG. 9, a schematic isometric view of another embodiment of a development system 70 for an electrophotographic copier or printer is shown. The development system 70 is similar to the development system 21 of FIG. 2, except it includes a second dispensing roll 74 and associated scorotron 76 that are mounted on the translatable carriage 72. The same electrical biases are provided in development system 70 as provided in development system 64 shown in FIG. 5. As in the embodiment of FIG. 2, the carriage 72 has the housing 35 and first dispensing roll 34 with associated scorotron 17 mounted thereon for translation thereby. Dispensing roll 34 and second dispensing roll 74 have the same dimensions with length D of about 5 to 15 cm. Housing 35 has a length of H that is less than the length D of the dispensing rolls 34,74. The dispensing rolls 34, 74 selectively meter charged toner from the housing 35 onto sections of the magnetic brush 20 as toner additions are needed. In a manner similar to that described for the development system 46 shown in FIG. 3, a metering blade (not shown) that is attached to the housing opening meters a layer of uncharged toner onto the dispensing roll 34. The toner layer is ion or electron charged by, for example, a scoroton 17, and the charged toner is transferred to the dispensing roll 74 with the assistance of an electrical bias provided by DC voltage source 62. The toner layer on the second dispensing roll 74 is then charged by another ion or electron charging device 76, such as, for example, a scorotron that is mounted on the carriage 72.

As the magnetic brush 20 loads charged toner onto the donor rolls 55,56 that in turn develops electrostatic latent images at a development zone, regions of the donor rolls become depleted of charged toner. As the magnetic brush re-supplies charged toner to the donor rolls, regions of the magnetic brush 20 may contain less charged toner in the two component developer layer thereon. These regions of depleted toner may be determined for example, by a toner concentration sensor 28 (shown in FIG. 1) and/or in combination with feed-forward image content data supplied by a controller (not shown) that is typically provided in an electrophotographic copier or printer. The carriage 72 is slidingly mounted on guide rails 37 and may be translated by any suitable means, such as, for example, by a cable 38 connected on opposing sides of the carriage 72 that is entrained about an idler roller or pulley (not shown) and a driven pulley 39. The driven pulley 39 may be driven by, for example, a reversible motor (not shown) to shuttle the carriage back and forth along the guide rails 37 as indicated by arrow 43.

The housing 35 is periodically re-filled with uncharged toner through aperture 41 shown in dashed line. The re-filling may be accomplished by a fixed supply bottle (not shown) located at a station at one end of the guide rails 37, so that the supply bottle may be inserted into the housing aperture 41 from time to time as the carriage enters the re-filling station. In another re-supply embodiment shown in FIG. 9, a fixed toner supply bottle 40 is connected to the housing aperture 41 by a flexible tube 42 having a rotatable spiral transporter therein to transport the uncharged toner from the supply bottle 40 to the housing 35.

Figure 10:
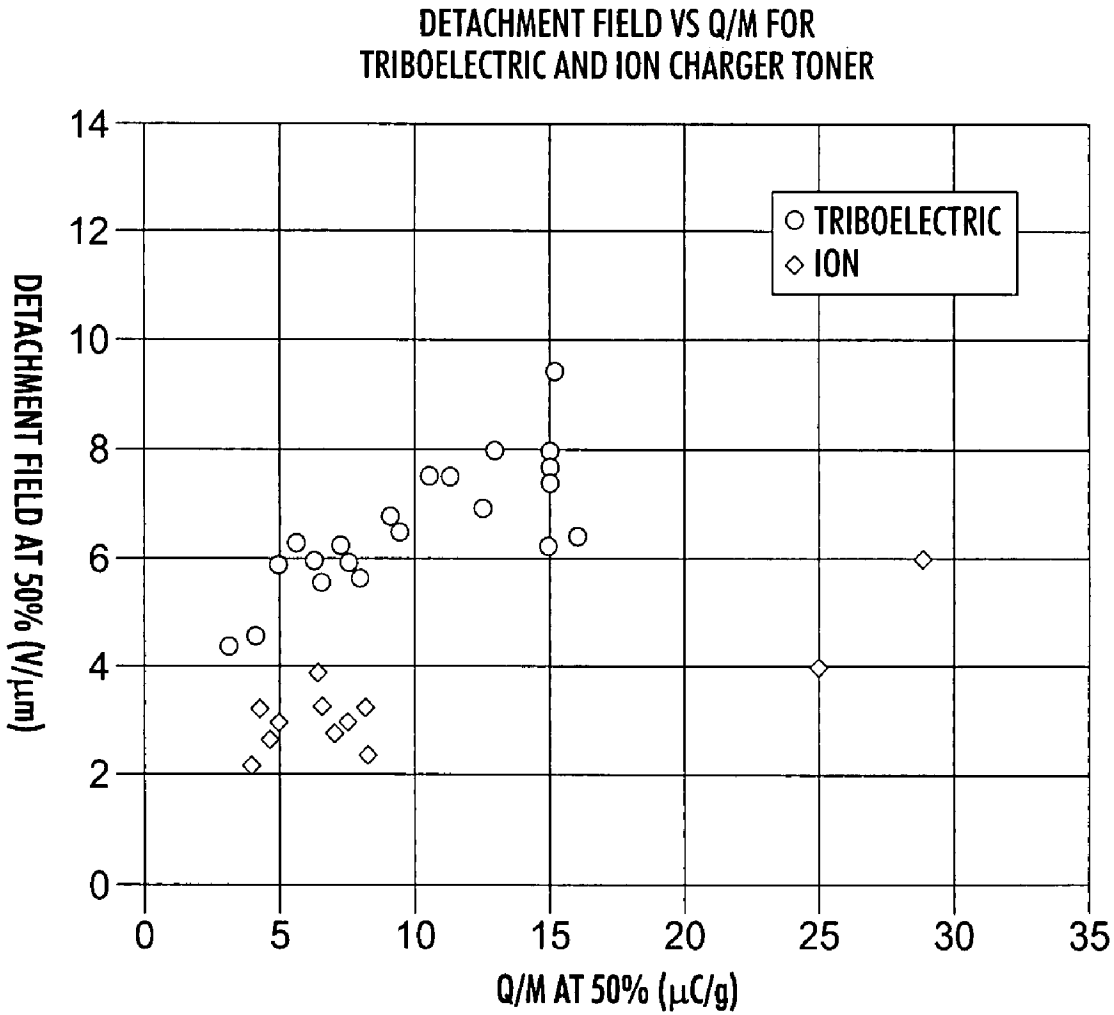
FIG. 10 is a data plot showing dependence of electric field detachment of toner on the toner charge level for ion and triboelectric charged toner.

Toner charging with ions or electrons has a number of advantages over triboelectrically charging of toner, including insensitivity to material surface properties, no relative humidity dependence, and very importantly reduced adhesion. To illustrate the low toner adhesion advantages of ion or electron charged toner, the electric field detachment data for toner charged by triboelectricity and ions are compared as shown in FIG. 10. The data plot in FIG. 10 shows the dependence of the electric field detachment on the toner charge level for the two types of toner charging. The detachment electric field at 50% removal is plotted versus charge per mass ratio (Q/M) of toner detached at 50% removal. The upper set of data represented by circles was obtained with triboelectric charged toner, whereas the lower set of data represented by diamonds was obtained with ion charged toner. The different charge levels for the triboelectic charged toner were obtained by mixing the toner with carrier beads coated with different percentages of PMMA and Kynar®. The triboelectrically charged toner was deposited onto an aluminum electrode by a magnetic brush. For the ion charged toner, the data for Q/M<8 μC/g was obtained with toner charged by an airborne corona charging device and deposited on the aluminum electrode. For Q/M>8 μC/g, the boosted ion charging was obtained by first corona charging the top side of the deposited toner, then electric field transferring it to a receiver and corona charging the former bottom side, as described above with respect to FIGS. 6 to 8.

Figure 11:
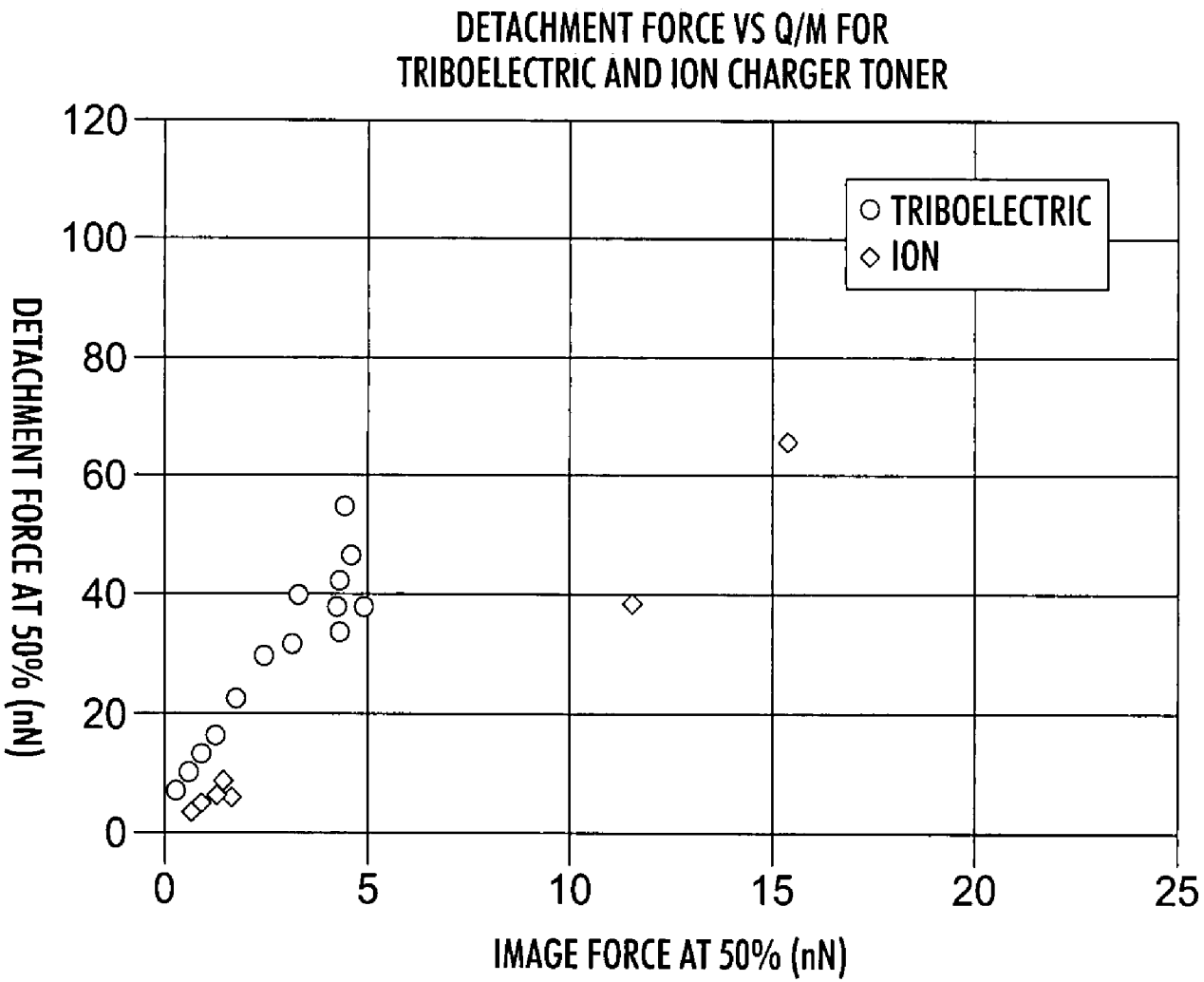
FIG. 11 is a data plot showing the electric field detachment force versus electrostatic image force for ion and triboelectric charged toner.

FIG. 11 shows a data plot of the detachment force at 50% removal versus the electrostatic image force at 50% removal for ion and triboelectric charged toner. As in FIG. 10, the ion charged toner is represented by diamonds and the triboelectric charged toner is represented by cirlces. The non-electrostatic force (i.e., Q/M=0) is small compared to the electrostatic contribution for both charging methods. The electrostatic adhesion is dominant in both cases for typical toner charge levels, however, the detachment electric field for ion charged toner is about half of that for the triboelectric charged toner. The difference is attributed to a more uniform surface charge distribution on the ion charged toner.

As stated above, to obtain the toner flow for metering and dispensing, the toner 14 is about 8 nm size silica and preferably CAB-O-SIL TS® from Cabot Corporation that is treated fumed silica. The surface additive concentration can be in the range of 0.1 to 0.3% by weight for a typical toner size 8 μm. The carrier beads on the magnetic brush 20 are a bare surfaced conductive or semi-conductive particles of about 50 μm in size.

Although a monochrome printing apparatus has been described in the above Specification, the claims can encompass embodiments that print in color or handle color image data.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A two component development system for developing an electrostatic latent image on an imaging surface of an electrophotographic machine, comprising:

a housing containing a supply of uncharged toner, said housing having an opening with two parallel opposing lips;

a first rotatable dispensing roll positioned in said housing opening and in contact with said supply of toner, the first dispensing roll being parallel to said housing lips;

a metering blade mounted on one of said housing lips and in contact with said first dispensing roll, said metering blade being arranged for metering a layer of uncharged toner onto said first dispensing roll;

a rotatable magnetic brush having magnetic, conductive or semi-conductive carrier beads thereon, said carrier beads being in contact with said layer of toner on said first dispensing roll, and said magnetic brush having a length substantially equal to the width of said imaging surface;

a first ion or electron charging device confronting said first dispensing roll and being positioned between said housing and said magnetic brush and downstream from said metering blade for placing an ion or electron charge on said layer of toner on said first dispensing roll prior to contact of said layer of toner with said magnetic brush;

a voltage source being connected to said magnetic brush for assisting in the transfer of the ion or electron charged toner from said first dispensing roll onto the carrier beads of said magnetic brush to form a layer of two component developer on said magnetic brush; and said magnetic brush being rotated toward a development zone where an electrostatic latent image recorded on a moving imaging surface is developed.

2. The development system as claimed in claim 1, wherein said housing is positioned above said first dispensing roll, so that gravity assists in maintaining said supply of uncharged toner in said housing against said first dispensing roll.

3. The development system as claimed in claim 1, wherein said magnetic brush comprises a rotatable outer tubular member for holding carrier beads captive thereon, and a magnetic cylindrical member having magnetic pole pieces spaced there around, said cylindrical member with said pole pieces being located within said tubular member; and wherein said tubular member and said cylindrical member are rotated in opposite directions to assist in the lateral diffusion of said charged toner with said carrier beads, whereby a relatively uniform layer of two component developer is maintained on said magnetic brush.

4. The development system as claimed in claim 1, wherein said first ion or electron charging device is a wire or pin corotron or a screen scorotron.

5. The development system as claimed in claim 1, wherein said first ion or electron charging device comprises nanotubes.

6. The development system as claimed in claim 1, wherein said housing, first dispensing roll, and first ion or electron charging device are mounted on a translatable carriage for translation thereby, said housing and said first dispensing roll have a length shorter than said magnetic brush, said carriage being translated back and forth in a direction parallel to said magnetic brush, so that said first dispensing roll may meter charged toner therefrom onto selected regions of said magnetic brush where said layer of two component developer may have toner depleted therefrom.

7. The development system as claimed in claim 6, wherein said first dispensing roll has a length of 5 to 15 cm.

8. The development system as claimed in claim 6, wherein said housing mounted on said translatable carriage has an aperture therein, a toner supply bottle containing uncharged toner, and a flexible tube interconnecting the supply bottle and said housing aperture.

9. The development system as claimed in claim 8, wherein said flexible tube has a rotatable spiral transporter therein for moving said uncharged toner from said supply bottle to said housing on said translatable carriage.

10. The development system as claimed in claim 1, wherein said development zone further comprises at least one donor roll located between said magnetic brush and imaging surface with said electrostatic latent image thereon, said at least one donor roll being in contact with said magnetic brush and spaced from said imaging surface to form a gap there between, whereat a toner cloud is formed to develop said electrostatic latent image on said imaging surface.

11. The development system as claimed in claim 10, wherein said development zone has a pair of donor rolls in contact with said magnetic brush and spaced from said imaging surface to form said development zone whereat said toner cloud is formed to develop said electrostatic latent image on said imaging surface.

12. The development system as claimed in claim 1, wherein said development system further comprises;

a second dispensing roll positioned between and in contact with said first dispensing roll and said magnetic brush;

a second ion or electron charging device adjacent said second dispensing roll; and at least one donor roll located between said magnetic brush and imaging surface, said at least one donor roll being in contact with said magnetic brush and spaced from said imaging surface to form a gap there between, said gap defining said development zone, whereat a toner cloud is formed to develop an electrostatic latent image on said imaging surface.

13. The development system as claimed in claim 1, wherein said metering blade has a distal end and contacts said first dispensing roll at a location spaced from said distal end of said metering blade, so that said metering blade overhangs said first dispensing roll and permits the uncharged toner from said housing to wedge underneath said distal end of said metering blade, whereby the amount of overhang of said distal end of said metering blade establishes the thickness of said layer of toner on said first dispensing roll.

14. The development system as claimed in claim 1, wherein said development system further comprises a wiper blade mounted on said other lip of said housing opening, the wiper blade being oriented in a doctor blade position to remove toner from said first dispensing roll when said rotational direction of said first dispensing roll is reversed from a printing direction prior to a prolonged shutdown of said development system.

15. A two component development system for developing an electrostatic latent image on an imaging surface of an electrophotographic machine, the imaging surface having a width that determines the process printing width of said machine, comprising:

a rotatably mounted magnetic brush having a length at least equal to said process printing width;

a translatable carriage being adapted for translation adjacent and parallel to said magnetic brush;

a housing having a length H shorter than said magnetic brush and containing a supply of uncharged toner, said housing being mounted on said carriage for translation thereby, and having an elongated opening with two opposing parallel lips and an aperture for refilling said housing with uncharged toner;

a first dispensing roll rotatably mounted on said carriage at a location adjacent said housing opening and parallel to said housing lips, the location of said first dispensing roll being fixed relative to said housing and in contact with said magnetic brush, so that the housing and first dispensing roll are translated together on said carriage back and forth in a direction parallel to and along the length of said magnetic brush, during the translation of the carriage, the first dispensing roll remains in contact with said magnetic brush at a location generally opposing the housing opening, said first dispensing roll being in contact with said uncharged toner in said housing at said housing opening and having a length D shorter than said magnetic brush but longer than said housing;

a metering blade mounted on one of said lips of said housing opening and having an overhanging contact with said first dispensing roll to meter a layer of uncharged toner onto said first dispensing roll from said housing opening;

an ion or electron charging device mounted on said carriage for translation thereby, said ion or electron charging device being positioned adjacent said first dispensing roll and between said metering blade and said magnetic brush, so that said layer of uncharged toner on said first dispensing roll is charged prior to being transported to said magnetic brush by said first dispensing roll to form a layer of two component developer on said magnetic brush; and drive means for translating said carriage along said magnetic brush so that said first dispensing roll may meter charged toner onto and along the length of said magnetic brush.

16. The development system as claimed in claim 15, wherein said development system further comprises:

a second dispensing roll rotatably mounted on said carriage between and in contact with said first dispensing roll and said magnetic brush, said second dispensing roll being substantially the same as said first dispensing roll; and a second ion or electron charging device mounted adjacent said second dispensing roll and on said carriage for translation thereby, said second ion or electron charging device being located between said first dispensing and said magnetic brush whereby the toner is more uniformly charged prior to being deposited on said magnetic brush by said second dispensing roll.

17. The development system as claimed in claim 15, wherein said development zone further comprises at least one rotatably mounted donor roll positioned between the magnetic brush and said imaging surface, said at least one donor roll being in contact with said magnetic brush and spaced from said imaging surface to form a gap between said donor roll and said imaging surface, whereat a toner cloud may be produced with the aid of an AC and DC electrical bias applied to said donor roll to develop an electrostatic latent image on said imaging surface.

18. The development system as claimed in claim 15, wherein said development system further comprises a toner concentration sensor mounted adjacent said magnetic brush to sense toner depleted regions in said layer of two component developer on said magnetic brush, so that said first dispensing roll may be transported by said carriage directly to said toner depleted regions in said layer of two component developer.

19. A two component development system for developing an electrostatic latent image on an imaging surface of an electrophotographic machine, comprising:

a housing containing a supply of uncharged toner, said housing having an opening with two parallel opposing lips;

a first rotatable dispensing roll positioned in said housing opening and in contact with said supply of toner, the first dispensing roll being parallel to said housing lips;

a metering blade mounted on one of said housing lips and in contact with said first dispensing roll, said metering blade being arranged for metering a layer of uncharged toner onto said first dispensing roll;

a rotatable magnetic brush having magnetic, conductive or semi-conductive carrier beads thereon, said carrier beads being in contact with said layer of toner on said first dispensing roll, and said magnetic brush having a length substantially equal to the width of said imaging surface;

a first ion or electron charging device confronting said first dispensing roll and being positioned between said housing and said magnetic brush and downstream from said metering blade for placing an ion or electron charge on said layer of toner on said first dispensing roll prior to contact of said layer of toner with said magnetic brush, wherein said first ion or electron charging device is selected from the group consisting of a wire corotron, a pin corotron, a screen scorotron, and carbon nanotubes;

a voltage source being connected to said magnetic brush for assisting in the transfer of the ion or electron charged toner from said first dispensing roll onto the carrier beads of said magnetic brush to form a layer of two component developer on said magnetic brush; and said magnetic brush being rotated toward a development zone where an electrostatic latent image recorded on a moving imaging surface is developed.

* * * * *